US005383795A

United States Patent [19]

Falossi et al.

[11] Patent Number: 5,383,795

[45] Date of Patent: Jan. 24, 1995

[54] UNISEX CONNECTOR/MODULAR ADAPTER SYSTEMS

[76] Inventors: Aldo Falossi, 22496 Caminito Grande, Laguna Hills, Calif. 92653; Paul Thomas, 1257 W. O'Farrell St., San Pedro, Calif. 90731

[21] Appl. No.: 241,799

[22] Filed: May 12, 1994

Related U.S. Application Data

[62] Division of Ser. No. 55,980, May 3, 1993, Pat. No. 5,348,494.

[51] Int. Cl.[6] ..... H01R 13/677

[52] U.S. Cl. ..... 439/362; 439/638

[58] Field of Search ..... 439/296, 299, 359, 362, 439/365, 445, 447, 460, 465, 470, 471, 638, 639, 650, 676, 906, 731; 403/321, 322

[56] References Cited

U.S. PATENT DOCUMENTS

| | | | |
|---|---|---|---|
| 3,904,265 | 9/1975 | Hollyday et al. | 439/469 |
| 4,130,330 | 12/1978 | Chandler | 439/358 |
| 4,210,380 | 7/1980 | Brzostek | 439/456 |
| 4,367,005 | 1/1983 | Douty et al. | 439/357 |
| 4,629,276 | 12/1986 | Genaro et al. | 439/449 |
| 4,632,489 | 12/1986 | Skinner | 439/459 |
| 4,749,369 | 6/1988 | Wang | 439/459 |
| 4,861,276 | 8/1989 | Muller et al. | 439/362 X |
| 4,878,848 | 11/1989 | Ingalsbe | 439/76 |
| 4,929,184 | 5/1990 | Emadi et al. | 439/362 X |
| 4,997,305 | 3/1991 | Yang | 439/362 X |
| 5,098,312 | 3/1992 | Raczynski | 439/367 |
| 5,118,301 | 6/1992 | Bentivolio | 439/188 |

*Primary Examiner*—Khiem Nguyen

*Attorney, Agent, or Firm*—Thomas I. Rozsa; Tony D. Chen

[57] ABSTRACT

The present invention is a connector shell assembly that retains both a conventional connector and a strain relief or radio jack which is attached to the extended rear end of the connector shell. The connector shell assembly also has unisex spring-load turn wheel mechanisms which do not need tools to be installed.

30 Claims, 12 Drawing Sheets

UNISEX CONNECTOR/MODULAR ADAPTER SYSTEMS

This is a divisional of copending application(s) Ser. No. 07/055,980 filed on May 3, 1993 now U.S. Pat. No. 5,348,494.

BACKGROUND OF THE INVENTION

1. Field of The Invention

The present invention relates to electronic connectors for use with cables. In particular, the present invention relates to an electronic connector shell assembly with a strain relief or radio jack attached to the extended rear end of a connector shell for providing strain relief for a cable during use. The connector shell assembly also provides unisex spring-loaded turn wheel mechanisms.

2. Description of The Prior Art

The concept of connector shell assembly and strain relief for relieving any strain that otherwise might be transmitted to the joint between the cable wires and the multiple wire connector is old in the art. In general, there are many types of connector shell assemblies, strain reliefs and radio jacks in today's electronic industry. Generally, these devices are sold separately by many different manufacturers. When installing a conventional connector into a connector shell, it is customary to provide strain relief to prevent the detachment of one or more of the wires from the connector during use. Of course, as the number of wires in the cable increase, more of the apertures in the connector are used and the size of the cable increases.

In the prior art, various types of connector shell assemblies have been provided with elaborate arrangements for receiving and retaining a multiple wire connector and have included cable strain relief provisions that have clamped the cable to or within the assembly in various manners. Such cable strain reliefs have taken various forms, including collars to be tightened about the cable by threaded fasteners, wedges that are forced into gripping engagement with the cable adjacent the entrance of the cable into the shell, and gripping blocks that slide along linear passages within the shell that extend generally transverse to the direction of the cable, with those blocks being slid into gripping engagement with the cable and held there by various forms of detents.

While many of these clamping devices have provided for certain strain relief, most have required the use of various tools to effect their engagement in a manner strong enough to retain the cables. The disadvantage of using these types of devices is that the tools required have been as simple as screwdrivers or as complex as specially configured pliers. The requirement for such tools are inconvenient and imposes an extra burden on the cable assembly manufacturers.

Another disadvantage of the prior art devices is that the hardware used to fasten the plug and the mating side of the plug together requires a particular gender type, such as screw fasteners and nut fasteners. These types of hardware have been utilized in the electronic industry for a very long time. The requirement for gender type creates the problem of finding the appropriate gender types to be mated together.

Another disadvantage is the tremendous financial burden on businesses to carry every different type of hardware and strain reliefs in their inventory.

Therefore, to correct these problems in the electronic industry, it is necessary to reduce the different types of hardware and strain reliefs used, and to reduce manufacturing costs.

The following prior art references are relevant to the field of the present invention.

1. U.S. Pat. No. 3,904,265 issued to Hollyday et al. on Sep. 9, 1975 for "Electrical Connector Shield Having An Internal Cable Clamp" (hereafter "the Hollyday Patent").

2. U.S. Pat. No. 4,130,330 issued to Chandler on Dec. 19, 1978 for "Electrical Connector Strain Relief And Cover Retention System" (hereafter "the Chandler Patent").

3. U.S. Pat. No. 4,210,380 issued to Brzostek on Jul. 1, 1980 for "Cable Connector Housing Having Strain Relief System" (hereafter "the Brzostek Patent").

4. U.S. Pat. No. 4,367,005 issued to Douty et al. on Jan. 4, 1983 for "Strain Relief Cover" (hereafter "the Douty Patent").

5. U.S. Pat. No. 4,629,276 issued to Genaro et al. on Dec. 16, 1986 for "Multidirection Connector Housing" (hereafter "the Genaro Patent").

6. U.S. Pat. No. 4,632,489 issued to Skinner on Dec. 30, 1986 for "Hood For Electronic Cable Connector" (hereafter "the Skinner Patent").

7. U.S. Pat. No. 4,749,369 issued to Wang on Jun. 7, 1988 for "Connector" (hereafter "the Wang Patent").

8. U.S. Pat. No. 4,878,848 issued to Ingalsbe on Nov. 7, 1989 for "110 Block Adapter" (hereafter "the Ingalsbe Patent").

9. U.S. Pat. No. 5,118,301 issued to Bentivolio on Jun. 2, 1992 for "Electrical Connector Device" (hereafter "the Bentivolio Patent").

The Hollyday Patent discloses an electrical connector shield having an internal cable clamp. It includes an insulating housing consisting of two hinged halves. One end retains an electrical connector and the other end contains an opening defined by arcuate portions and a curved inner wall against which electrical leads emanating from the connector are simultaneously clamped and deflected away from the shield at an angle, The Chandler Patent discloses an electrical connector strain relief and cover retention system. The cover is for either the plug or receptacle. The cover further is provided with an integral cable support having parallel arms. A cable is received between the arms which are provided with multiple ratchet teeth on their inwardly facing sides. The cable clamping plug is manually inserted between the arms of the cable support.

The Brzostek Patent discloses a cable connector housing having a strain relief system. It includes a first portion with a base and a second portion mateable with the first portion. The first portion comprises a plurality of posts each having a slotted free end and projecting therefrom in a predetermined pattern. The pattern provides a plurality of cable paths which extend from the entrance end to the connector with a predetermined path for each cross-sectional size cable within a range of sizes which causes engagement of the cable with one or more of the posts to provide suitable strain relief for the cable during use. The second portion has a plurality of apertures therethrough which are adapted to receive the posts when the portions are mated together.

The Douty Patent discloses a strain relief cover. It includes a pair of hermaphroditic cover members of rigid insulation material. Each cover member has a forward mating edge with a plurality of parallel spaced tongues projecting therefrom for reception in the terminal passages of the connector.

The Genaro Patent discloses a multidirection connector housing. It includes a body portion, a strain relief portion and a locking mechanism for locking the body and the strain relief portions together in at least seven orientations with respect to a connector plug.

The Skinner Patent discloses a hood for receiving and partially enclosing an electronic cable connector and for grippingly engaging a portion of an electronic cable. The hood assembly includes two identical mirror-image housing portions and two gripper elements. The housing portions house the connector and the gripper elements provide a firm gripping engagement on the cable outside the hood to the relatively delicate connections between the cable wires and the connector.

The Wang Patent discloses an improved connector. It includes upper and lower case bodies, a sliding clip, and a plug. The upper and lower case bodies do not have an extended section for a strain relief.

The Ingalsbe Patent discloses a telecommunications interface adapter system for connecting a modular connector to a 110-type Block Terminal.

The Bentivolio Patent discloses an electrical connector device. It includes first and second male terminal sets associated with each connector face. Each terminal set comprises a multiplicity of at least two terminals adapted to couple to a matched female electrical connector.

None of the prior art patents are designed to accommodate a connector shell assembly that retains both a conventional connector and a strain relief or radio jack in which the strain relief or radio jack can be attached to the extended rear end of the connector shell assembly. Also, none of the prior art patents utilize unisex spring-loaded turn wheel mechanisms which do not require tools to be installed and can be utilized with various types of connector sizes.

Accordingly, it is desirable to enclose the back side of such a connector, where such delicate cable wires are connected, within a connector shell assembly that supports both the connector and the strain relief or radio jack which holds a portion of the cable. It is also desirable to provide to the connector shell assembly a means for engaging the overall cable, and thereby relieving any strain that otherwise might be transmitted to the joint between the cable wires and the multiple wire connector. In addition, previous methods of strain relief such as ratchet, screws, etc., actually put strain on the cable while providing retention of the cable. A strain relief should be made of soft material in order to provide significant relief. It is further desirable to provide unisex hardware to the connector shell assemblies.

SUMMARY OF THE INVENTION

The present invention is a connector shell assembly that retains both a conventional connector and a strain relief or radio jack which is attached to the extended rear end of the connector shell. The novelty of the strain relief is that it does not put strain on the cable wires, but in fact the strain is spread over the extended length of the cable. The strain relief is a flexible holder comprising a cable entrance with many different inner diameters. The connector shell assembly also has unisex spring-load turn wheel mechanisms which do not require tools to be installed. The primary object of the present invention is to provide a means to retain both the conventional connector and the strain relief or radio jack in the connector shell, and to reduce the hardware components utilized in connecting the conventional connector and the strain relief or radio jack.

The present invention is a novel and unique connector shell assembly particularly designed for electronic applications. It has been discovered, according to the present invention, that in many situations such as in electronic applications, it is inconvenient to locate the particular hardware gender for mating and attaching the opposite connectors together because the hardware utilized in the electronic industry is the type that employs gender hardware. Therefore, it is an important object of the present invention to provide a unisex spring-loaded turn wheel mechanism which provides unisex hardware.

It has additionally been discovered, according to the present invention, that in many situations such as in electronic applications, it is highly desirable to employ connector shell assemblies that are compact in size and do not require any additional hardware to connect the opposite halves of the connector shell. Therefore, it is an additional object of the present invention to provide a connector shell assembly that has a very efficient and very effective design and construction which provides a means for snapping together the two halves of a connector shell in a manner that does not require hardware.

It has further been discovered, according to the present invention, that in many situations such as in electronic applications, it is highly desirable to employ a connector shell assembly that is capable of incorporating an extended rear end for retaining a strain relief or radio jack, which in turn will relieve any strain that otherwise might be transmitted to the joint between the cable wires. Therefore, it is a further object of the present invention to provide a connector shell with extended rear end which can support the strain relief or radio jack.

In the preferred embodiment of the present invention, the connector shell assembly comprises a conventional connector, a connector shell having two identical halves which are of the same structure, a strain relief having two identical halves which are of the same structure, and two unisex spring-loaded turn wheel mechanisms.

The essential components of the alternative embodiment of the present invention connector shell assembly include a connector shell having two identical halves and two unisex spring-loaded turn wheel mechanisms.

In an alternative embodiment of the present invention, the connector shell assembly comprises a conventional connector, a connector shell having two identical halves which are of the same structure, a conventional radio jack, and two unisex spring-loaded turn wheel mechanisms.

The conventional connector is attached to the front end of the connector shell, while the strain relief or radio jack is attached to the extended rear end of the connector shell. The two identical halves of the connector shell are snapped together in a manner such that each male fastener post is connected to its corresponding female fastener recess with both the conventional connector and the strain relief or radio jack enclosed within the connector shell and the two unisex spring-loaded turn wheel mechanisms attached to the lateral sides of the connector shell. The unisex spring-load turn wheel hardware makes changing of the connectors simple since the conventional radio jacks and the conventional connectors are somewhat unisex at inception and by adding the appropriate pins to the cable wires, one can establish the gender hardware.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a connector shell assembly which can hold both a conventional connector and a strain relief or radio jack. The present invention is particularly designed for electronic applications. In a typical embodiment of the present invention, the connector shell assembly comprises a conventional connector, a connector shell having two identical halves which are of the same structure, a strain relief having two identical halves which are of the same structure or radio jack, and two unisex spring-loaded turn wheel mechanisms. The essential components of the present invention connector shell assembly are the connector shell, the strain relief, and the unisex spring-loaded turn wheel mechanisms.

Figure 1:
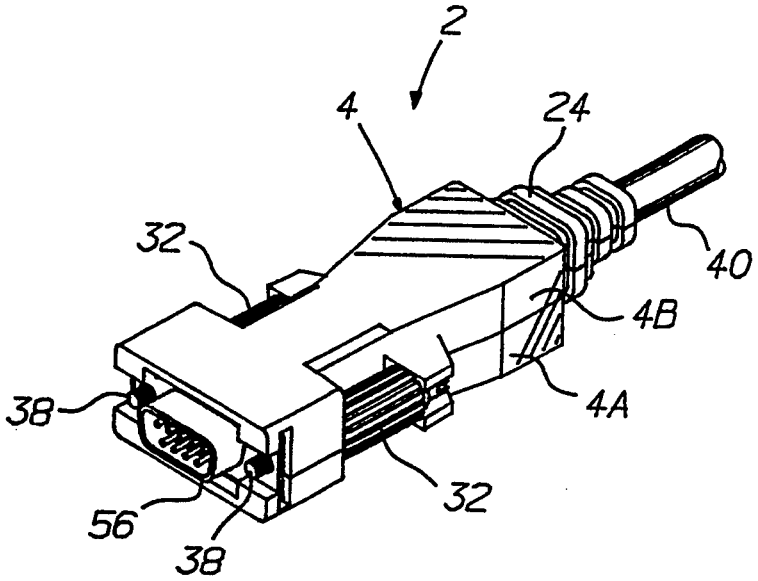
FIG. 1 is a perspective view of the present invention connector shell assembly assembled with a conventional 9-pin male connector and a strain relief.

Referring to FIG. 1, there is shown at 2 a connector shell assembly comprising an elongated rigid connector shell 4 for retaining a conventional 9-pin male connector 56, an elongated flexible strain relief 24 and two unisex spring-loaded turn wheel mechanisms 32. The elongated rigid connector shell 4 receives and partially encloses the 9-pin male connector 56 and the strain relief 24. The connector shell 4 comprises a first half 4A and an identical second half 4B which are of the same structure, and therefore their parts which are identical will be described by the same reference number 4 (referring to both 4A and 4B) in the text hereinafter.

Figure 2:
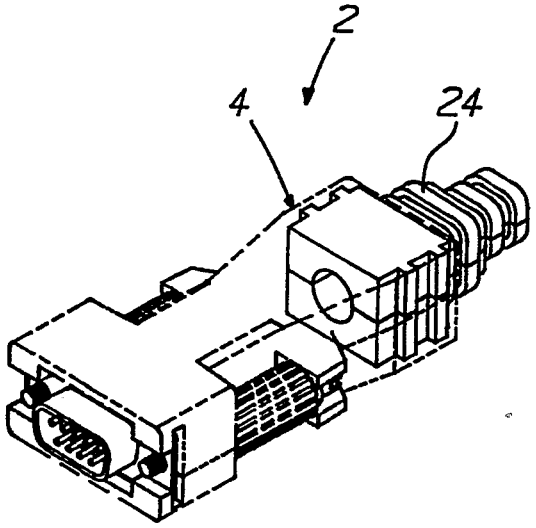
FIG. 2 is a perspective view of the connector shell assembly shown in dashed lines and the strain relief installed at the rear end of the connector shell.
Figure 3:
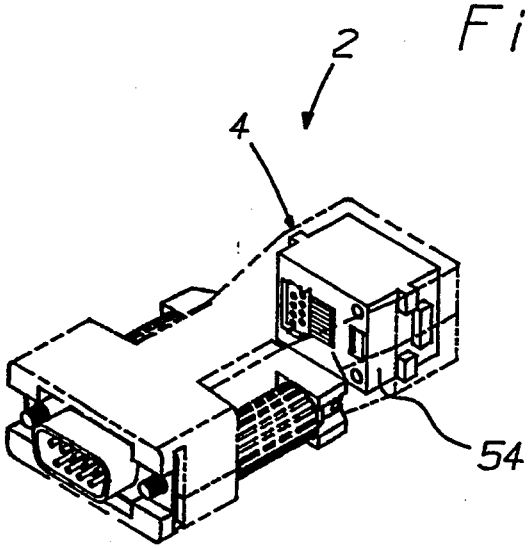
FIG. 3 is a perspective view of the connector shell assembly shown in dashed lines and a radio jack installed at the rear end of the connector shell.

As illustrated in FIGS. 2 and 3, the connector shell assembly 4 is shown in dashed lines with the strain relief 24 and a radio jack 54 installed therein respectively.

Figure 4:
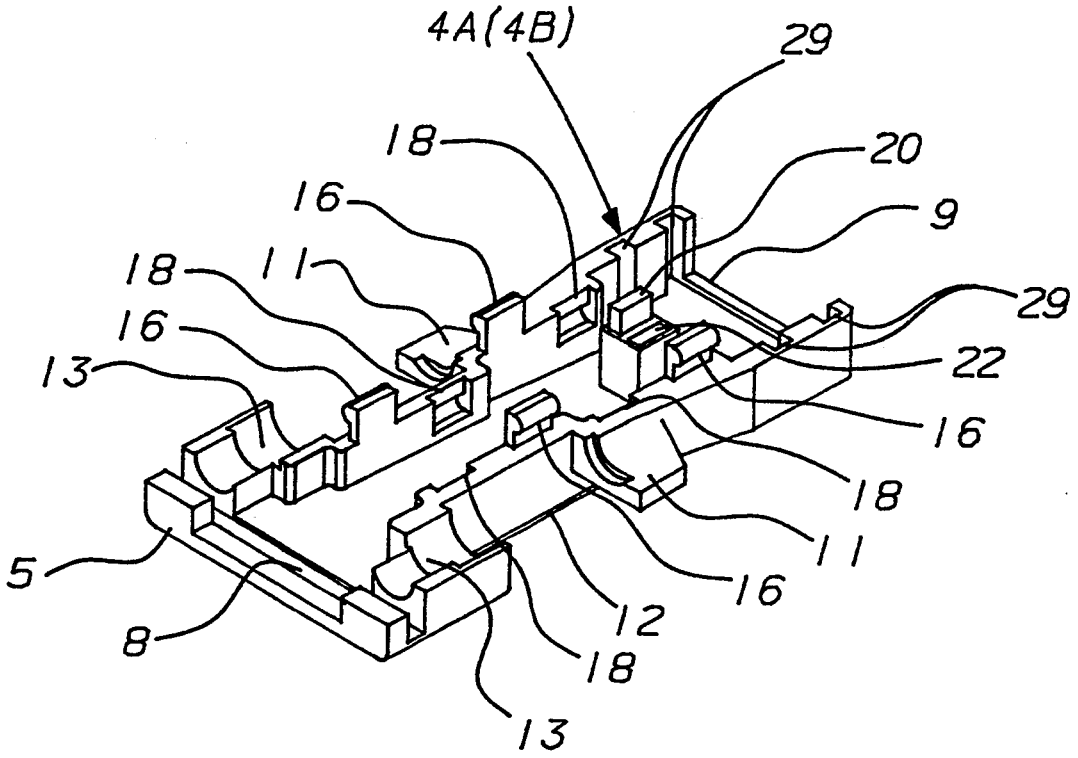
FIG. 4 is an enlarged perspective view of one of the two identical halves of the connector shell.

Referring to FIG. 4, there is shown an enlarged half 4A or 4B of the connector shell 4. Each half has a longitudinal slot at its front end 5 for housing the 9-pin connector and an extended rear end 9 for housing the strain relief or radio jack. Also shown is a transverse slot 8 on its front end 5 for receiving a transverse plate of the 9-pin connector and two transverse slots 29 on its extended rear end 9. The connector shell 4 further comprises four lateral male fastener posts 16, four lateral female fastener recesses 18, a central male fastener post 20 and a central female fastener recess 22. There are two male fastener posts 16 and two female fastener recesses 18 located alternatively on each lateral side of the shell half 4A (or 4B). In addition, the two male fastener posts 16 on one lateral side are offset with the two female fastener recesses 18 on the opposite lateral side, so that the male fastener posts 16 and the female fastener recesses 18 on one shell half 4A are complementary to those on another shell half 4B when the connector shell halves 4A and 4B are mated together. The central male fastener post 20 and female fastener recess 22 are located adjacent to the extended rear end 9 of the connector shell half 4A (or 4B).

Figure 5:
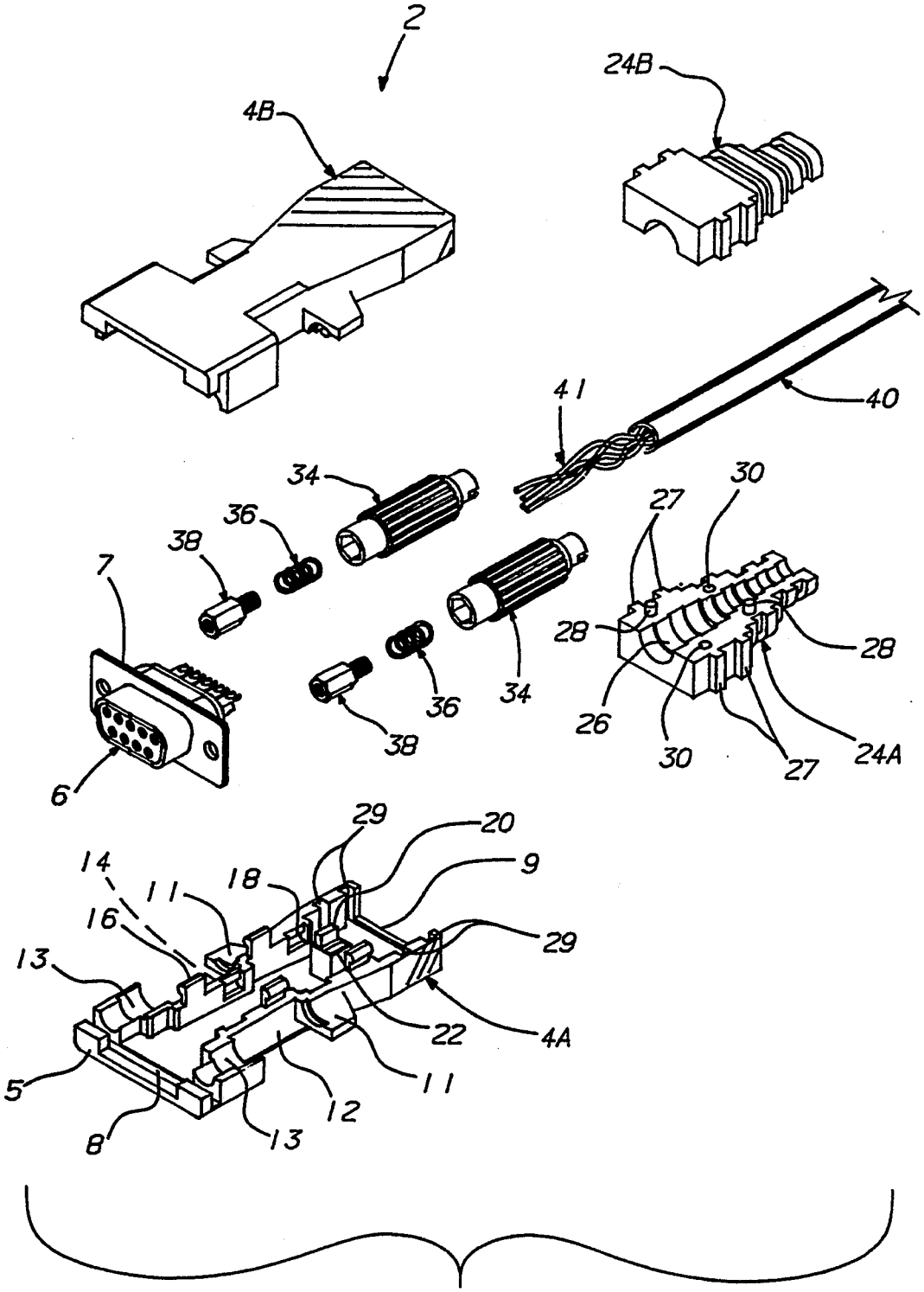
FIG. 5 is an exploded view of the present invention connector shell assembly showing a conventional 9-pin female connector, two unisex spring-loaded turn wheel mechanisms showing the female hardware, two identical halves of the connector shell, two identical halves of the strain relief and the cable with wires.

Referring to FIG. 5, there is shown an exploded view of the connector shell assembly 2. The strain relief 24 is a flexible holder comprising a first half 24A and an identical second half 24B which are of the same structure, and therefore their parts which are identical will be described by the same reference number 24 (referring to both 24A and 24B) in the text hereinafter. When the two halves of the strain relief 24 are snapped together, it forms an internal channel 26 which engages against the opposite sides of the cable 40 for relieving any strain that otherwise might be transmitted to the joint between the cable wires 41 and the connector 6. As illustrated in FIG. 5, the internal channel 26 has many different inner diameters incorporated therein so that it can accommodate many different cable sizes. The cable 40 is placed within the internal channel 26 of the strain relief 24, where it can be seized by cutting off the excess strain relief 24. Cables of many different diameters can be kept firmly within the internal channel 26 because of the many different diameters that the internal channel 26 can accommodate. The strain of the strain relief 24 is spread out over an extended length of the cable. Each half further comprises one male fastener post 28 and one female fastener recess 30 on each lateral side of the strain relief half 24A (or 24B). The female fastener recesses 30 are offset from the opposite male fastener posts 28, so that the male fastener posts 28 on one strain relief half 24A are complementary to the female fastener recesses 30 on the other strain half 24B. The strain relief half 24A (and 24B) also has two lateral ribs 27 which are accommodated by the two lateral recesses 29 on the connector shell half 4A (and 4B), which prevent the strain relief 24 from longitudinal movement within the connector shell 4. By way of example, the strain relief 24 is approximately 1.00 inch in length and 0.75 inches in thickness respectively.

It will be appreciated that these dimensions as described above are merely one illustrative embodiment and can include many other comparable sets of dimensions.

The connector shell 4 and the strain relief 24 can be made from several materials. The manufacturing process which could accommodate the construction of the connector shell 4 and the strain relief 24 may be injection, thermoform, etc. or other molding process. By way of example, the connector shell 4 can be made of plastic material and the strain relief 24 can be made of synthetic rubber. The strain relief 24 can be made of any suitable soft material in order to provide significant strain relief. The molding and mass production process would enable the connector shell assembly 2 to be produced inexpensively. The present invention is a viable article of manufacture, with realistic cost expenditures associated with its production.

The unisex spring-loaded turn wheel mechanisms 32 are attached to the connector shell 4 at its lateral sides. At each of the lateral sides 12 and 14 of the connector shell half 4A, a closed adapting member 13 and a partially open adapting member 11 are provided for accommodating the unisex spring-loaded turn wheels 32. The closed adapting members 13 of the two shell halves 4A and 4B fully enclose the first end 43 of the turn wheel 32, but the partially open adapting member 11 only partially encloses the second end 41 of turn wheel 32, so one may apply a screwdriver on the cross slot 42 at a tilted angle.

Figure 6:
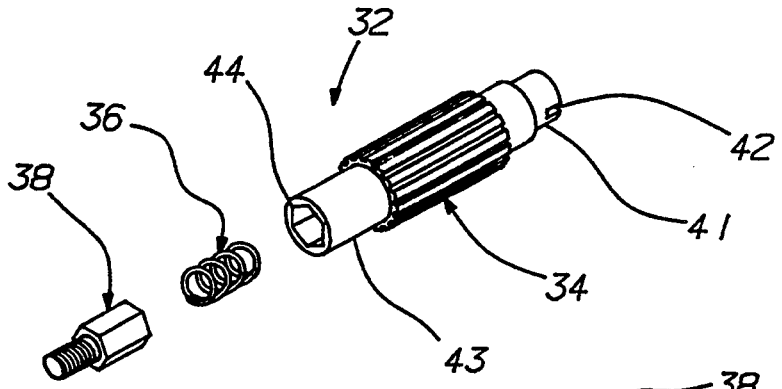
FIG. 6 is an exploded view of the unisex spring-loaded turn wheel mechanism with a gender reversible member, assembled to provide a male hardware.
Figure 7:
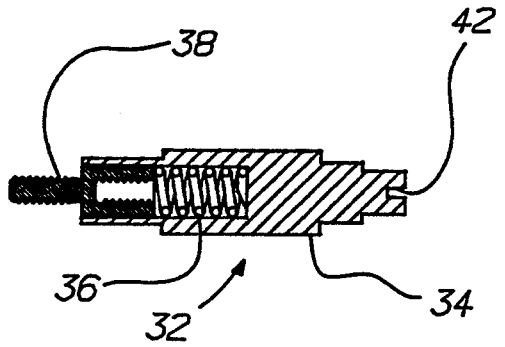
FIG. 7 is a cross-sectional view of the unisex spring-loaded turn wheel mechanism assembled to provide a male hardware, as illustrated in FIG. 11.
Figure 8:
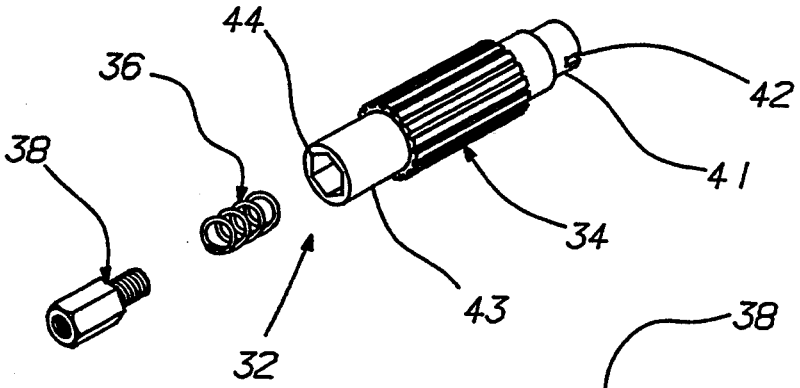
FIG. 8 is an exploded view of the unisex spring-loaded turn wheel mechanism with a gender reversible member, assembled to provide a female hardware.
Figure 9:
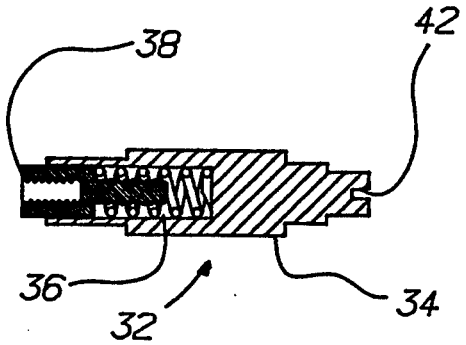
FIG. 9 is a cross-sectional view of the unisex spring-loaded turn wheel mechanism assembled to provide a female hardware, as illustrated in FIG. 5.

Referring to 6, 7, 8 and 9, there is shown at 32 a unisex spring-loaded turn wheel mechanism. FIG. 6 shows an exploded view of an assembly to provide a male hardware and FIG. 7 is a cross-sectional view of the assembled unit. Similarly, FIG. 8 shows an exploded view of an assembly to provide a female hardware and FIG. 9 is a cross-sectional view of the assembled unit. The unisex spring-loaded turn wheel mechanism comprises a spring 36, a reversible member 38 and a base 34. The base 34 comprises a first end 43 and a second end 41. The first end 43 has an opening 44 in which is placed the spring 36 and the reversible member 38 respectively. The second end 41 has a cross shape slot 42 for accommodating a screwdriver. The reversible member 38 can be reversed to provide either male or female hardware depending on the situation. By way of example, the unisex spring loaded turn wheel mechanism 32 can be made out of polycarbon material.

Referring again to FIG. 5, to assemble the connector shell assembly 2, the strain relief 24 is seized to fix the diameter of the cable 40 by cutting off the correct diameter of the internal channel 26 of the strain relief 24. The two halves of the strain relief 24 are fastened together in a manner such that each male fastener post is engaged with its corresponding female fastener recess. The transverse plate 7 of the connector 6 is inserted in the transverse slot 8 of front end 5 of the first half 4A of the connector shell 4 and the strain relief 24 is inserted in the two transverse slots 29 of the extended rear end 9, as illustrated in FIG. 2. The second half 4B of the connector shell 4 is then snapped to the first half 4A in a manner such that each male fastener post is engaged to its corresponding female fastener recess. The two unisex spring-loaded turn wheel mechanisms are held in place by the adapting members 11 and 13.

Figure 10:
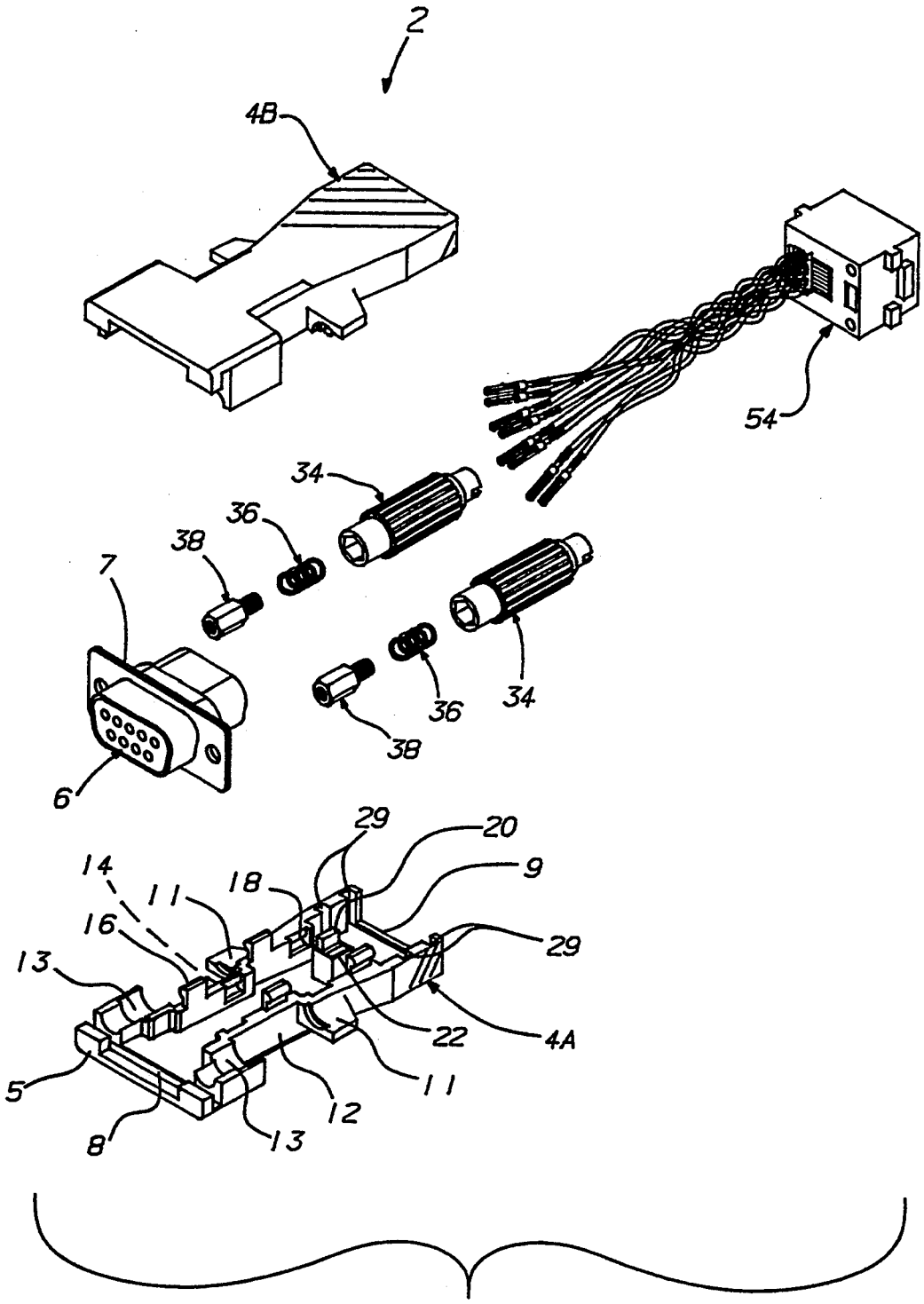
FIG. 10 is an exploded view of the present invention connector shell assembly showing a conventional 9-pin female connector, two unisex spring-loaded turn wheel mechanisms showing the female hardware, two identical halves of the connector shell and a radio jack with crimped female pins attached to the wires.

Referring to FIG. 10, there is shown at 2 a connector shell assembly comprising an elongated rigid connector shell 4 for retaining a 9-pin female connector 6, a conventional radio jack 54 and two unisex spring-loaded turn wheel mechanisms 32. The elongated rigid connector shell 4 receives and partially encloses the 9-pin female connector 6 and the conventional radio jack 54. The connector shell assembly 2 assembles and functions the same as described above with the radio jack 54 substituting for the strain relief, as illustrated in FIG. 3. The conventional radio jack 54 does not need to be cut because the extended rear end 9 of the connector shell 4 is made perfectly to fit a conventional radio jack 54.

Figure 11:
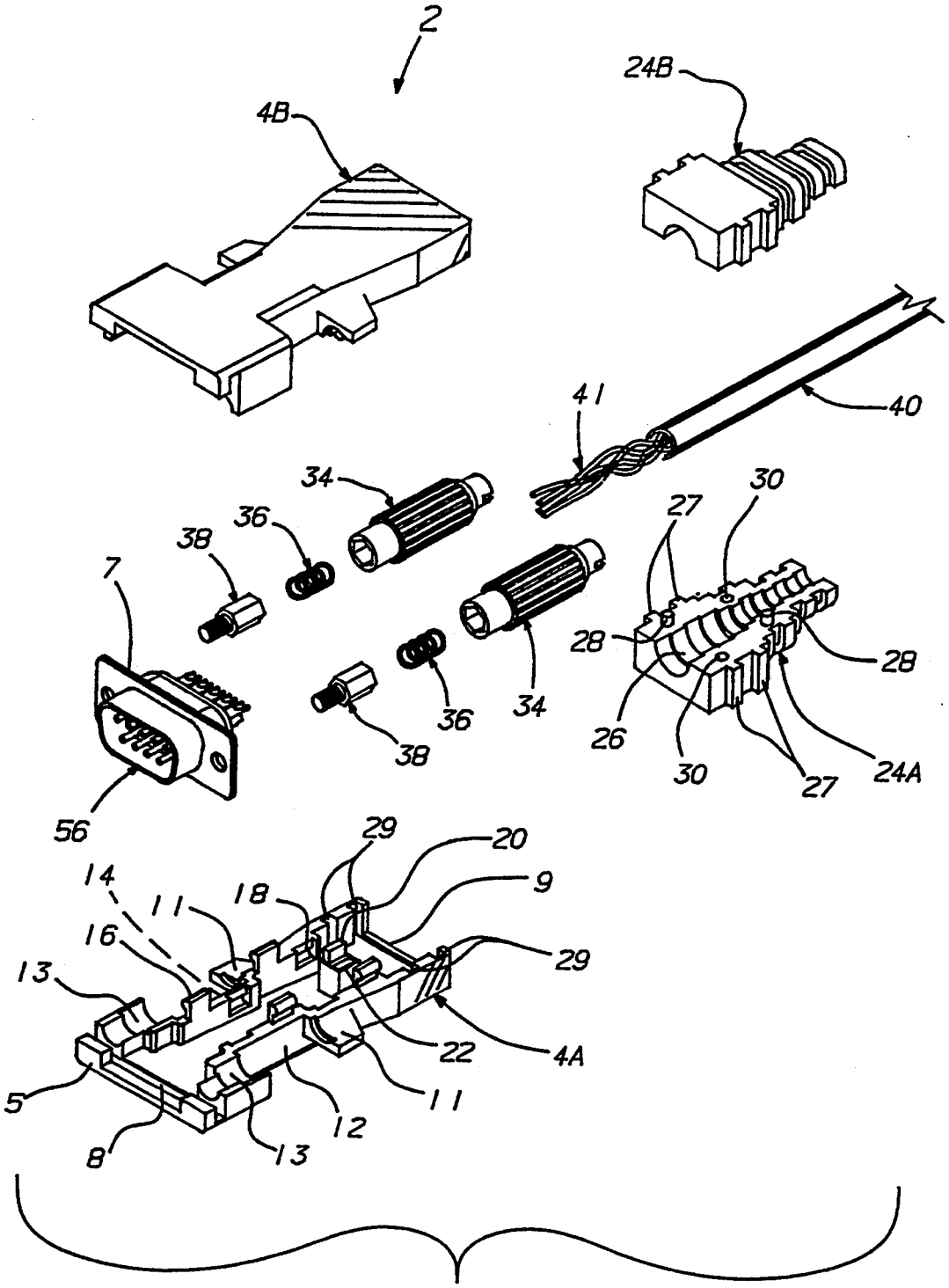
FIG. 11 is an exploded view of the present invention connector shell assembly showing a conventional 9-pin male connector, two unisex spring-loaded turn wheel mechanisms showing the male hardware, two identical halves of the connector shell, two identical halves of the strain relief and the cable with wires.

Referring to FIG. 11, there is shown at 2 a connector shell assembly comprising an elongated rigid connector shell 4 for retaining a 9-pin male connector 56, an elongated flexible strain relief 24 and two unisex spring-loaded turn wheel mechanisms 32. The elongated rigid connector shell 4 receives and partially encloses the 9-pin male connector 56 and the strain relief 24. The connector shell assembly 2 assembles and functions the same as described above with the 9-pin male connector 56 substituting for the 9-pin female connector.

Figure 12:
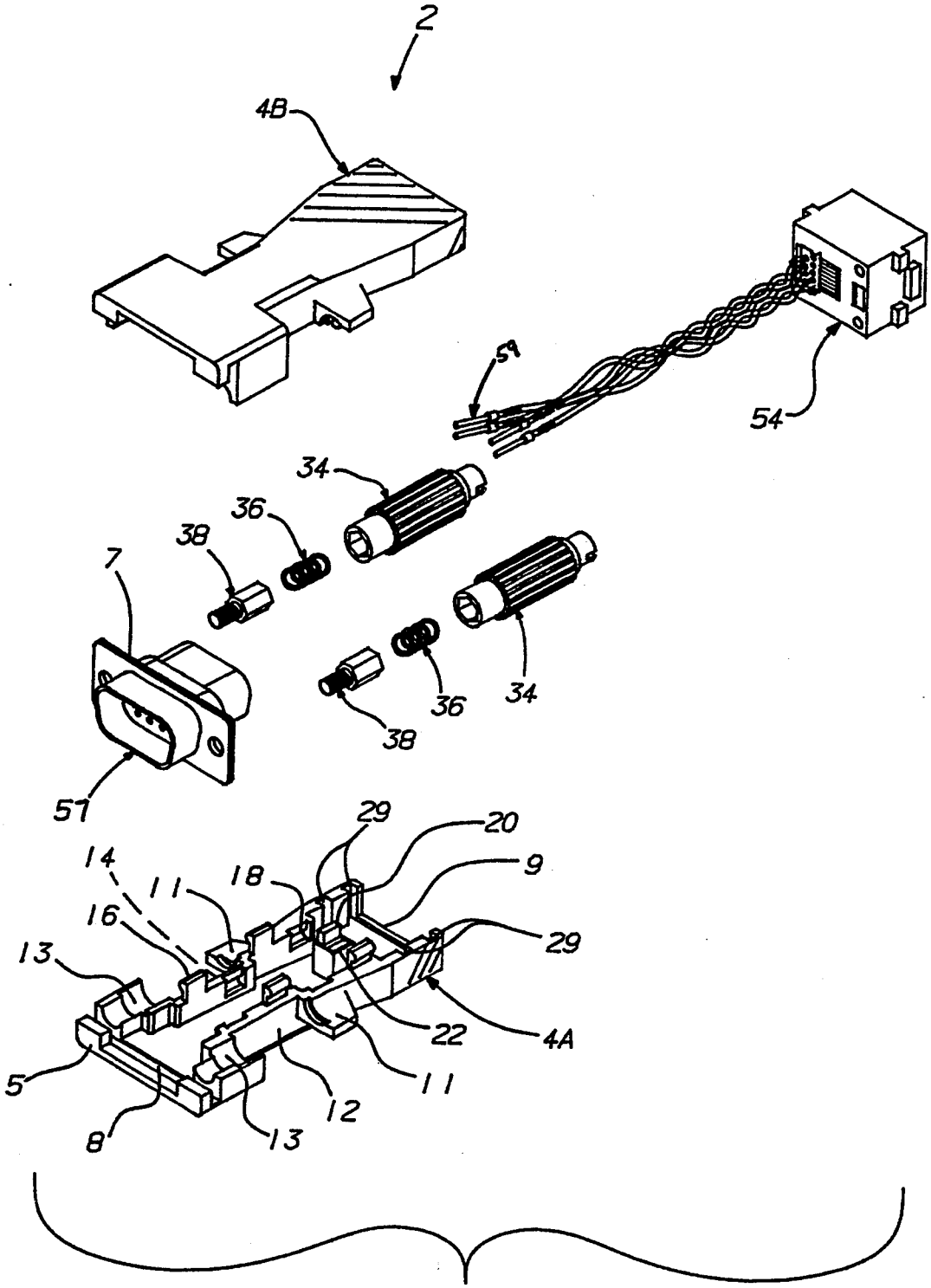
FIG. 12 is an exploded view of the present invention connector shell assembly showing a conventional 9-pin male connector, two unisex spring-loaded turn wheel mechanisms showing the male hardware, two identical halves of the connector shell and the radio jack with crimped male pins attached to the wires.

Referring to FIG. 12, there is shown at 2 a connector shell assembly comprising an elongated rigid connector shell 4 for retaining a 9-pin connector 57, a conventional radio jack 54 and two unisex spring-loaded turn wheel mechanisms 32. There is male pins 59 crimped onto the wires which is attached to the radio jack 54. The male pins 59 are provide to establish the gender type of the connector to be male. The elongated rigid connector shell 4 receives and partially encloses the 9-pin connector 57 and the conventional radio jack 54. The connector shell assembly 2 assembles and functions the same as previously described above.

Figure 13:
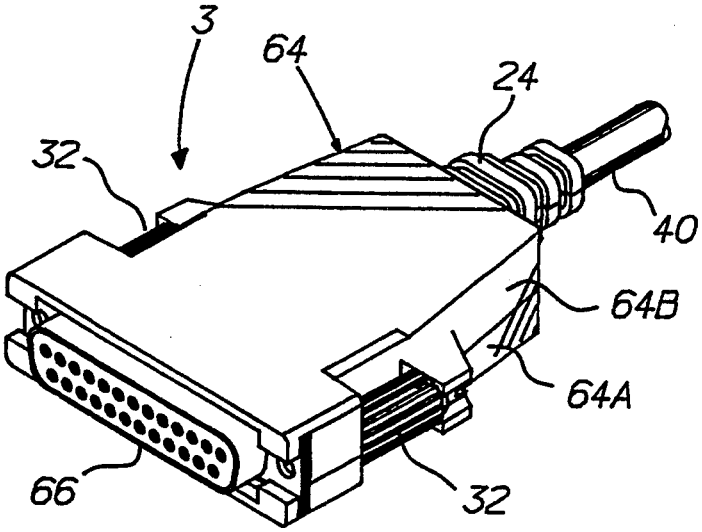
FIG. 13 is a perspective view of the present invention connector shell assembly assembled with a conventional 25-pin female connector and a strain relief.

Referring to FIG. 13, there is shown at 3 a connector shell assembly comprising an elongated rigid connector shell 64 for retaining a 25-pin female connector 66, an elongated flexible strain relief 24 and two unisex spring-loaded turn wheel mechanisms 32. The elongated rigid connector shell 64 receives and partially encloses the 25-pin female connector 66 and the strain relief 24. The connector shell 64 comprises a first half 64A and an identical second half 64B which are of the same structure, and therefore their parts which are identical will be described by the same reference number 64 (referring to both 64A and 64B) in the text hereinafter.

Figure 14:
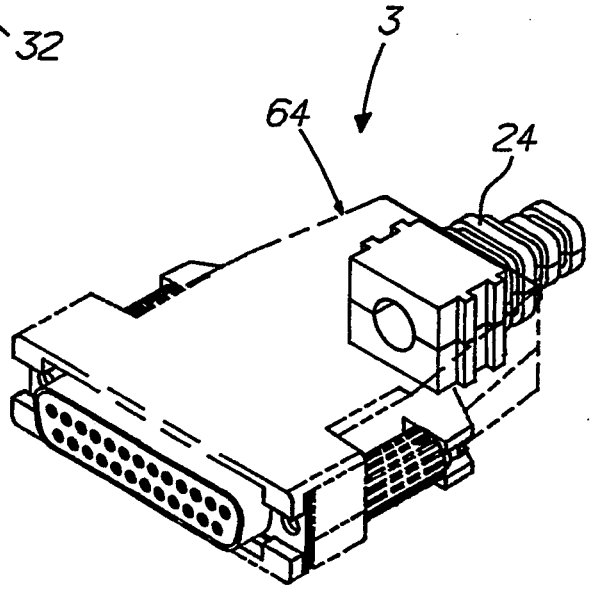
FIG. 14 is a perspective view of the connector shell assembly shown in dashed lines and the strain relief installed at the rear end of the connector shell.
Figure 15:
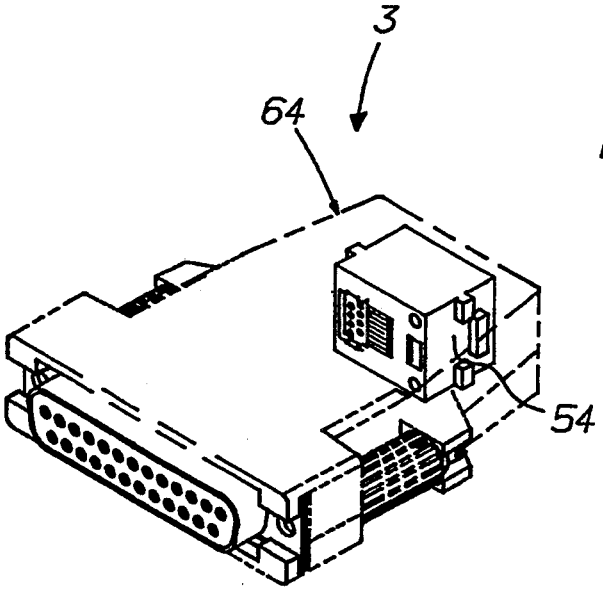
FIG. 15 is a perspective view of the connector shell assembly shown in dashed lines and the radio jack installed at the rear end of the connector shell.

As illustrated in FIGS. 14 and 15, the connector shell assembly 3 is shown in dashed lines with the strain relief 24 and a radio jack 54 installed therein respectively.

Figure 16:
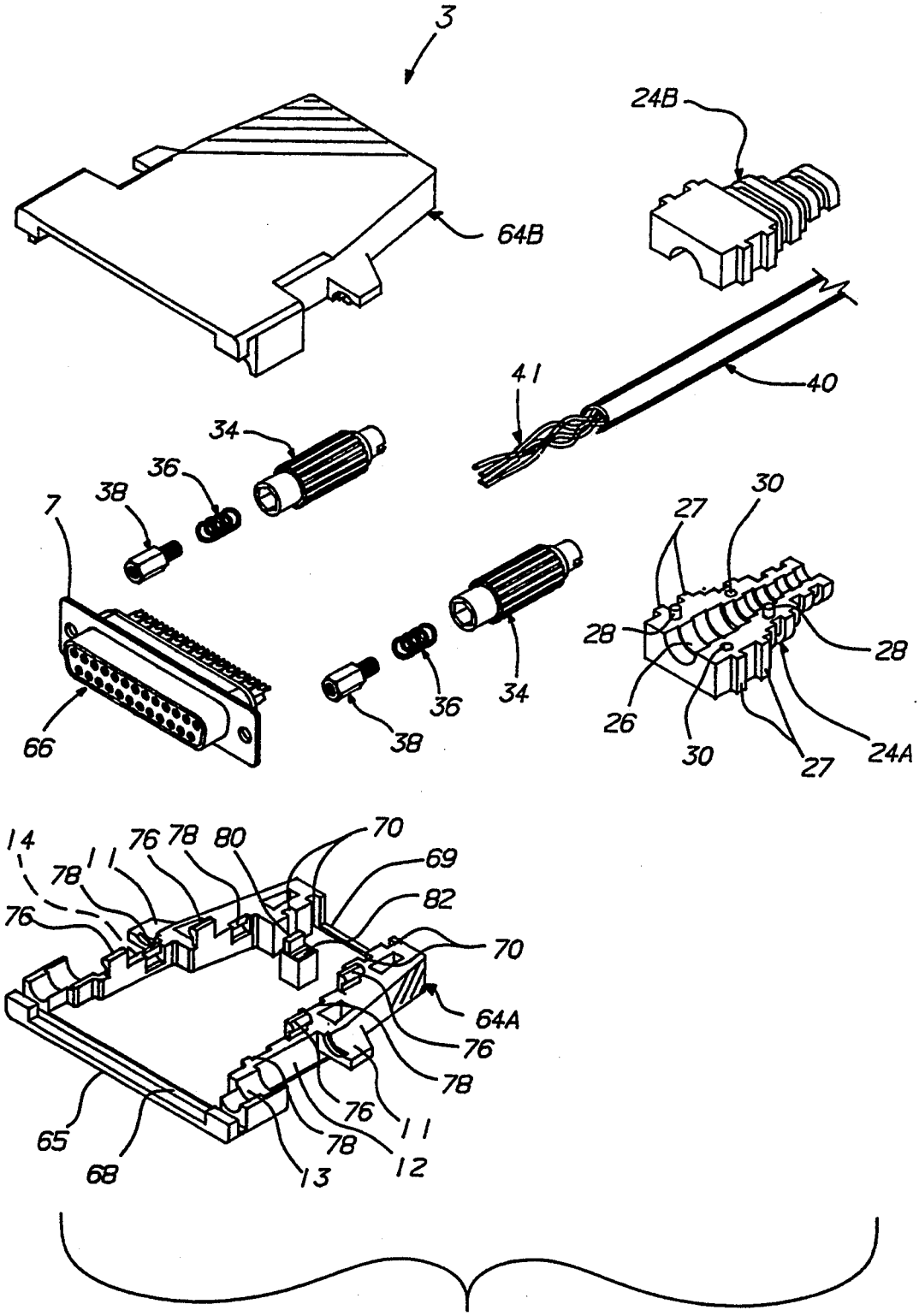
FIG. 16 is an exploded view of the present invention connector shell assembly showing a conventional 25-pin female connector, two unisex spring-loaded turn wheel mechanisms showing female hardware, two identical halves of the connector shell, two identical halves of the strain relief and the cable with wires.

Referring to FIG. 16, each half has a transverse slot 68 on the interior of its front end 65 and two transverse slots 70 on the interior of its extended rear end 69. It further comprises four lateral male fastener posts 76, four female fastener recesses 78, a central male fastener post 80 and a central female fastener recess 82. The connector shell assembly 3 assembles and functions the same as previously described in FIGS. 1, 4 and 5.

The strain relief 24 and the unisex spring-loaded turn wheel mechanism 32 are exactly the same as previously described in FIGS. 4, 5, 6, 7, 8 and 9. The connector shell assembly 3 assembles and functions the same as previously described above with the connector shell 64 being larger to accommodate a 25-pin female connector 66.

Figure 17:
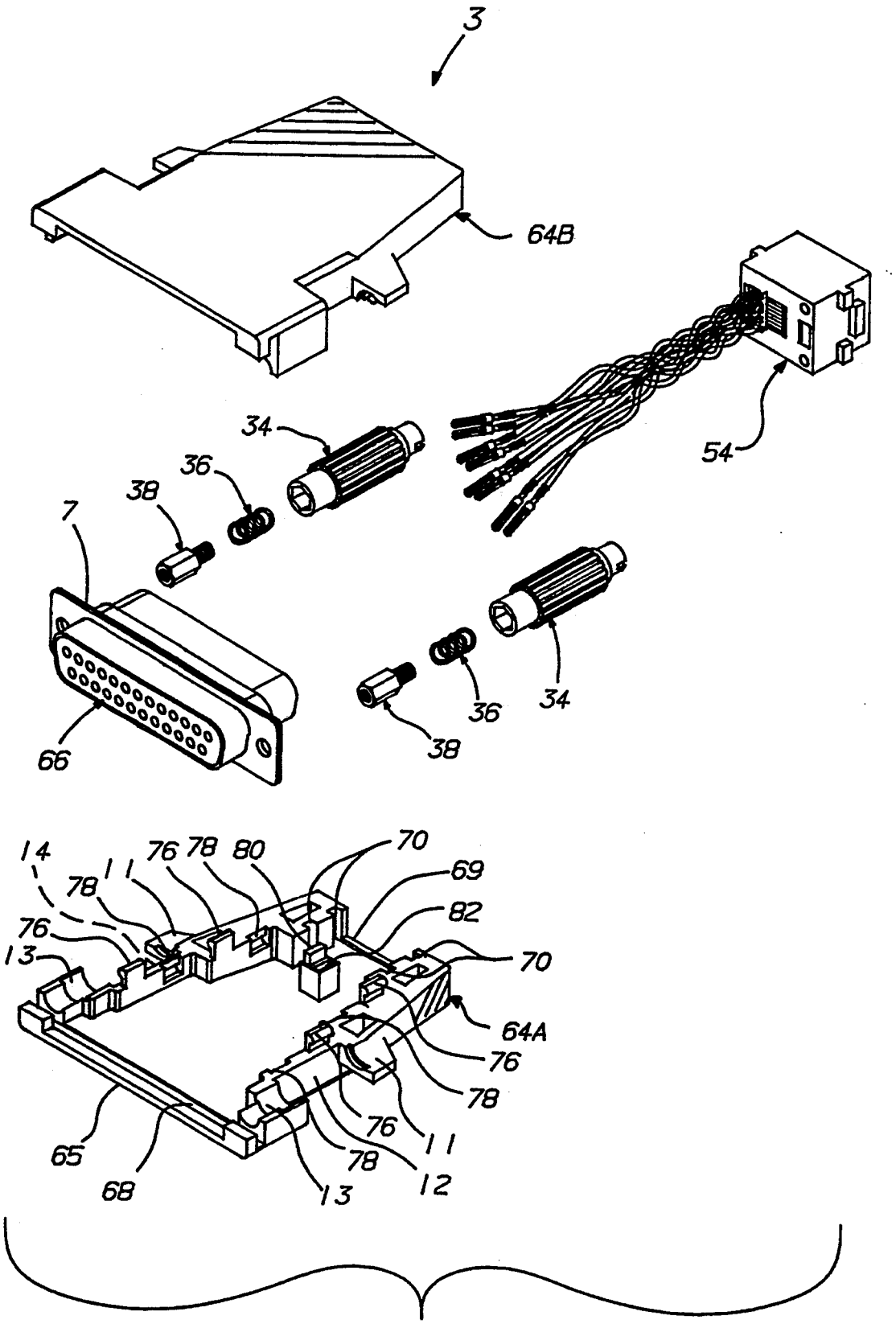
FIG. 17 is an exploded view of the present invention connector shell assembly showing a conventional 25-pin female connector, two unisex spring-loaded turn wheel mechanisms showing female hardware, two identical halves of the connector shell and the radio jack with crimped female socket pins attached to the wires.

Referring to FIG. 17, there is shown at 3 a connector shell assembly comprising an elongated rigid connector shell 64 for retaining a 25-pin female connector 66, a conventional radio jack 54 and two unisex spring-loaded turn wheel mechanisms 32. The elongated rigid connector shell 64 receives and partially encloses the 25-pin female connector 66 and the conventional radio jack 54. The connector shell assembly 3 assembles and functions the same as described above with the radio jack 54 substituting for the strain relief.

Figure 18:
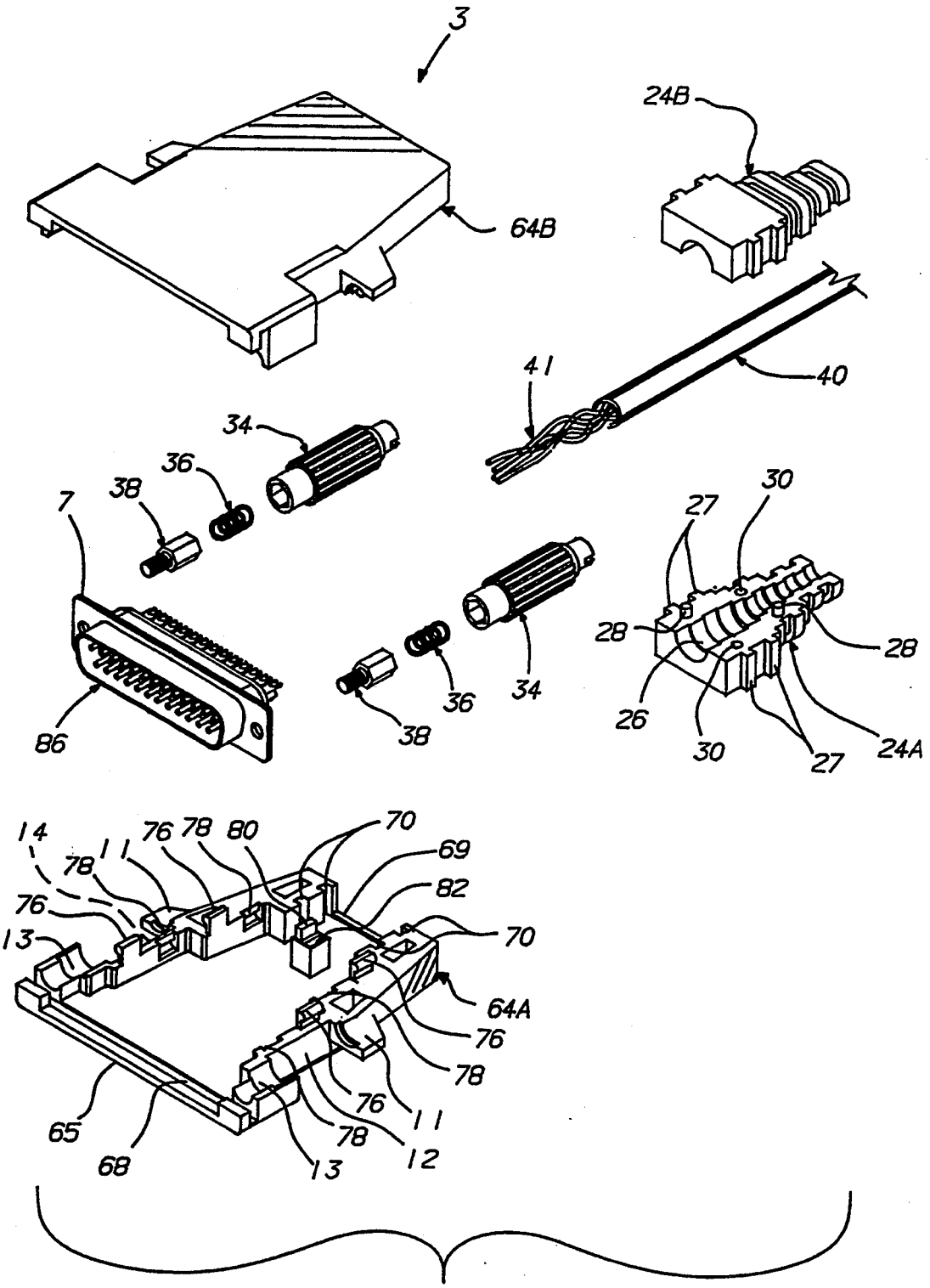
FIG. 18 is an exploded view of the present invention connector shell assembly showing a conventional 25-pin male connector, two unisex spring-loaded turn wheel mechanisms showing male hardware, two identical halves of the connector shell, two identical halves of the strain relief and the cable with wires.

Referring to FIG. 18, there is shown at 3 a connector shell assembly comprising an elongated rigid connector shell 64 for retaining a 25-pin male connector 86, an elongated flexible strain relief 24 and two unisex spring-loaded turn wheel mechanisms 32. The elongated rigid connector shell 64 receives and partially encloses the 25-pin male connector 86 and the strain relief 24. The connector shell assembly 3 assembles and functions the same as previously described above.

Figure 19:
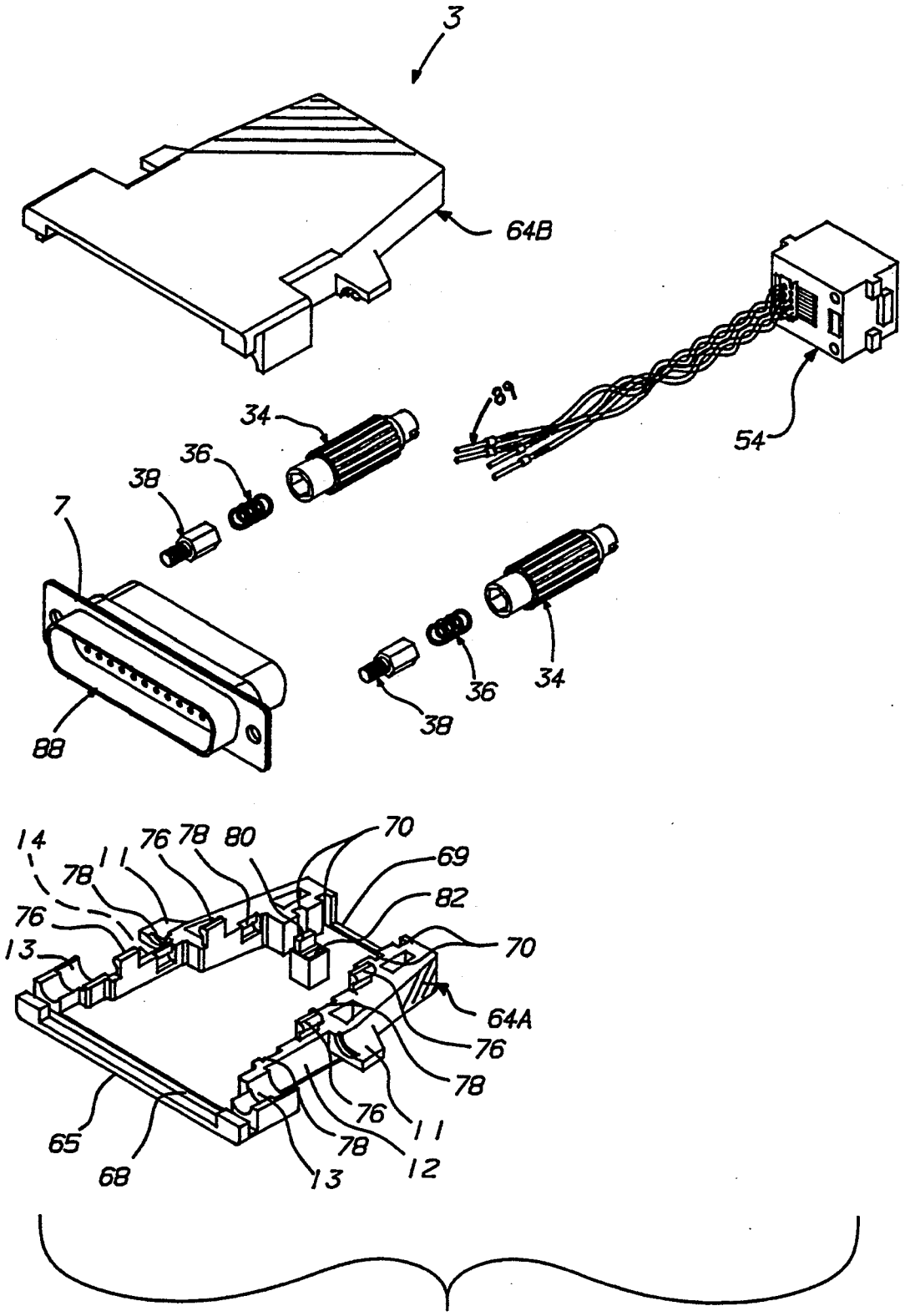
FIG. 19 is an exploded view of the present invention connector shell assembly showing a conventional 25-pin male connector, two unisex spring-loaded turn wheel mechanisms showing male hardware, two identical halves of the connector shell and the radio jack with crimped male pins attached to the wires.

Referring to FIG. 19, there is shown at 3 a connector shell assembly comprising an elongated rigid connector shell 64 for retaining a 25-pin connector 88, a conventional radio jack 54 and two unisex spring-loaded turn wheel mechanisms 32. There is male pins 89 crimped onto the wires which is attached to the radio jack 54. The male pins 59 are provide to establish the gender type of the connector to be male. The elongated rigid connector shell 64 receives and partially encloses the 25-pin connector 88 and the conventional radio jack 54. The connector shell assembly 3 assembles and functions the same as previously described above.

The above structures permit easy and simple assembling of the connector shell of to the present invention in the manner such as described above. The unisex hardware makes changing of the connectors simple since the conventional radio jacks, and the conventional 9-pin and 25-pin connectors are somewhat unisex at inception by crimping the appropriate pins to the cable wires, the user can establish the gender type of the connector shell assembly.

It will be appreciated that the present invention is not limited to the nine (9) and the twenty-five (25) pin connectors described above. It is emphasized that while the nine (9) and twenty-five (25) pin connectors are the preferred embodiment, it is also within the spirit and scope of the present invention to have any size connectors. In addition, it will not be too difficult for one skilled in the art to replace the nine (9) and the twenty-five (25) pin connectors with a different size connector.

The present invention has many advantageous features including: (a) it can be utilized with a strain relief or a radio jack; (b) it has a unisex spring-loaded turn wheel mechanism; (c) it has a self-fastening mechanism which does not require any additional hardware; and (d) it can be utilized with a plug or socket connectors.

Defined in detail, the present invention is a connector shell assembly for a 9-pin connector and a cable having a multiplicity of wires, the multiplicity of wires connected to the 9-pin connector, the connector shell assembly comprising: (a) an elongated rigid connector shell, an elongated flexible strain relief, and a first and a second unisex spring-loaded turn wheel mechanisms; (b) said connector shell having a first half and an identical second half, each half having a longitudinal slot with a front portion for housing said 9-pin connector, and a rear portion for housing said strain relief, a transverse slot on a front end for receiving a transverse plate of said 9-pin connector, a first and second transverse slots on an extended rear end for receiving a first and second lateral ribs of said strain relief, a first lateral side and a second lateral side; (c) means for interlocking said first and second halves of said connector shell together for receiving and partially enclosing said 9-pin connector and said strain relief; (d) said first and second unisex spring-loaded turn wheel mechanisms each having a spring, a reversible member and a base; (e) said reversible member having a first end and a second end, the first end has a male screw post and the second end has a female screw nut; (f) said base of said first and second unisex spring-loaded turn wheel mechanisms having a first end and a second end, the first end has an opening for accommodating said spring and said reversible member respectively, and the second end bas a cross shaped slot for accommodating a driving tool; (g) means for retaining said first and second unisex spring-loaded turn wheel mechanisms to said first and second lateral sides of said connector shell respectively; (h) said elongated flexible strain relief having a first half and an identical second half, each half having a front end, a rear end, a longitudinal channel with different cross-sectional dimensions and said lateral rib which prevent said strain relief from longitudinal movement within said connector shell; and (i) means for interlocking said first and second halves of said elongated flexible strain relief together to form an internal channel with different internal diameter for securely retaining said cable such that said two halves of said strain relief engage against opposite sides of said cable for relieving any strain transmitted on said cable; (j) whereby prior to snapping together said two halves of said connector shell, said 9-pin connector is placed in said longitudinal slot at said front portion of said first half of said connector shell and said transverse plate of said 9-pin connector is retained in said transverse slot of said front end of said first half of said connector shell, and said strain relief is placed in said longitudinal slot at said rear portion of said first half of said connector shell and said two lateral ribs of said strain relief is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said 9-pin connector and said strain relief.

Defined alternatively in detail, the present invention is a connector shell assembly for a 9-pin connector and a radio jack having a multiplicity of wires, the multiplicity of wires connected to the 9-pin connector, the connector shell assembly comprising: (a) an elongated rigid connector shell having a first half and an identical second half, each half having a longitudinal slot with a front portion for housing said 9-pin connector, and a rear portion for housing said radio jack, a transverse slot on a front end for receiving a transverse plate of said 9-pin connector, a first and a second transverse slots on an extended rear end for receiving a first and a second transverse notches of said radio jack, a first lateral side and a second lateral side; (b) means for interlocking said first and second halves of said connector shell together for receiving and partially enclosing said 9-pin connector and said radio jack; (c) a first and a second unisex spring-loaded turn wheel mechanisms each having a spring, a reversible member and a base; (d) said reversible member having a first end and a second end, the first end has a male screw post and the second end has a female screw nut; (e) said base of said first and second unisex spring-loaded turn wheel mechanisms having a first end and a second end, the first end has an opening for accommodating said spring and said reversible member respectively, and the second end has a cross shaped slot for accommodating a driving tool; and (f) means for retaining said first and second unisex spring-loaded turn wheel mechanisms to said first and second lateral sides of said connector shell respectively; (g) whereby prior to snapping together said two halves of said connector shell, said 9-pin connector is placed in said longitudinal slot at said front portion of said first half of said connector shell and said transverse plate of said 9-pin connector is retained in said transverse slot of said front end of said first half of said connector shell, and said radio jack is placed in said longitudinal slot at said rear portion of said first half of said connector shell and said two transverse notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said 9-pin connector and said radio jack.

Also defined in detail, the present invention is a connector shell assembly for a 25-pin connector and a cable having a multiplicity of wires, the multiplicity of wires connected to the 25-pin connector, the connector shell assembly comprising: (a) an elongated rigid connector shell, an elongated flexible strain relief, and a first and a second unisex spring-loaded turn wheel mechanisms; (b) said connector shell having a first half and an identical second half, each half having a longitudinal slot with a front portion for housing said 25-pin connector, and a rear portion for housing said strain relief, a transverse slot on a front end for receiving a transverse plate of said 25-pin connector, a first and second transverse slots on an extended rear end for receiving a first and second lateral ribs of said strain relief, a first lateral side and a second lateral side; (c) means for interlocking said first and second halves of said connector shell together for receiving and partially enclosing said 25-pin connector and said strain relief; (d) said first and second unisex spring-loaded turn wheel mechanisms each having a spring, a reversible member and a base; (e) said reversible member having a first end and a second end, the first end has a male screw post and the second end has a female screw nut; (f) said base of said first and second unisex spring-loaded turn wheel mechanisms having a first end and a second end, the first end has an opening for accommodating said spring and said reversible member respectively, and the second end has a cross shaped slot for accommodating a driving tool; (g) means for retaining said first and second unisex spring-loaded turn wheel mechanisms to said first and second lateral sides of said connector shell respectively; (h) said elongated flexible strain relief having a first half and an identical second half, each half having a front end, a rear end, a longitudinal channel with different cross-sectional dimensions and said lateral rib which prevent said strain relief from longitudinal movement within said connector shell; and (i) means for interlocking said first and second halves of said elongated flexible strain relief together to form an internal channel with different internal diameter for securely retaining said cable such that said two halves of said strain relief engage against opposite sides of said cable for relieving any strain transmitted on said cable; (j) whereby prior to snapping together said two halves of said connector shell, said 25-pin connector is placed in said longitudinal slot at said front portion of said first half of said connector shell and said transverse plate of said 25-pin connector is retained in said transverse slot of said front end of said first half of said connector shell, and said strain relief is placed in said longitudinal slot at said rear portion of said first half of said connector shell and said two lateral ribs of said strain relief is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said 5-pin connector and said strain relief.

Also defined alternatively in detail, the present invention is a connector shell assembly for a 25-pin connector and a radio jack having a multiplicity of wires, the multiplicity of wires connected to the 25-pin connector, the connector shell assembly comprising: (a) an elongated rigid connector shell having a first half and an identical second half, each half having a longitudinal slot with a front portion for housing said 25-pin connector, and a rear portion for housing said radio jack, a transverse slot on a front end for receiving a transverse plate of said 25-pin connector, a first and a second transverse slots on an extended rear end for receiving a first and a second transverse notches of said radio jack, a first lateral side and a second lateral side; (b) means for interlocking said first and second halves of said connector shell together for receiving and partially enclosing said 25-pin connector and said radio jack; (c) a first and a second unisex spring-loaded turn wheel mechanisms each having a spring, a reversible member and a base; (d) said reversible member having a first end and a second end, the first end has a male screw post and the second end has a female screw nut; (e) said base of said first and second unisex spring-loaded turn wheel mechanisms having a first end and a second end, the first end has an opening for accommodating said spring and said reversible member respectively, and the second end has a cross shaped slot for accommodating a driving tool; and (f) means for retaining said first and second unisex spring-loaded turn wheel mechanisms to said first and second lateral sides of said connector shell respectively; (g) whereby prior to snapping together said two halves of said connector shell, said 25-pin connector is placed in said longitudinal slot at said front portion of said first half of said connector shell and said transverse plate of said 25-pin connector is retained in said transverse slot of said front end of said first half of said connector shell, and said radio jack is placed in said longitudinal slot at said rear portion of said first half of said connector shell and said two transverse notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said 25-pin connector and said radio jack.

Defined broadly, the present invention is a connector shell assembly for a connector and an adapter having a multiplicity of wires, the multiplicity of wires connected to the connector, the connector shell assembly comprising: (a) a connector shell having two identical halves, each half having a longitudinal slot with a front portion for housing said connector, and a rear portion for housing said adapter, a transverse slot on a front end for receiving a transverse plate of said connector, two transverse slots on an extended rear end for receiving said adapter and two lateral sides; (b) means for interlocking said two identical halves of said connector shell together for receiving and partially enclosing said connector and said adapter; (c) two unisex spring-loaded turn wheel mechanisms each having a spring, a reversible member and a base; (d) said reversible member having a male screw post at one end and a female screw nut at an opposite end; (e) said base having an opening at one end for accommodating said spring and said reversible member respectively, and a cross shaped slot at an opposite end for accommodating a driving tool; and (f) means for retaining said two unisex spring-loaded turn wheel mechanisms to said two lateral sides of said connector shell; (g) whereby prior to snapping together said two halves of said connector shell, said connector is placed in said longitudinal slots at said front portions of said connector shell and said transverse plate of said connector is retained in said transverse slots of said front ends of said connector shell, and said adapter is placed in said longitudinal slots at said rear portions of said connector shell and said adapter is retained in said two transverse slots of said extended rear end of said connector shell, said springs and said reversible members are placed in said bases respectively of said two unisex spring-loaded turn wheel mechanisms which show said male screw posts for adapting an opposite said female screw nuts, said connector shell is snapped together to retained said connector and said adapter.

Further defined in detail, the present invention is a method of retaining a connector and a cable having a multiplicity of wires, the multiplicity of wires connected to the connector, the method comprising the steps of: (a) providing a connector shell having a first half and an identical second half, each half having a longitudinal slot with a front portion for housing said connector, and a rear portion for housing an elongated flexible strain relief, a transverse slot on a front end for receiving a transverse plate of said connector, a first and second transverse slots on an extended rear end for receiving a first and second lateral ribs of said strain relief, a first lateral side and a second lateral side; (b) interlocking said first and second halves of said connector shell together for receiving and partially enclosing said connector and said strain relief; (c) providing a first and a second unisex spring-loaded turn wheel mechanisms each having a spring, a reversible member and a base, the reversible member having a first end and a second end, the first end has a male screw post and the second end has a female screw nut, the base having a first end and a second end, the first end has an opening for accommodating said spring and the reversible member respectively, and the second end has a cross shaped slot for accommodating a driving tool; (d) changing said reversible member to said male screw post or said female screw nut by reversing said reversible member; (e) retaining said first and second unisex spring-loaded turn wheel mechanisms to said first and second lateral sides of said connector shell; (f) providing said elongated flexible strain relief having a first half and an identical second half, each half having a front end, a rear end, a longitudinal channel with different cross-sectional dimensions and said lateral rib which prevent said strain relief from longitudinal movement within said connector shell; and (g) interlocking said first and second halves of said elongated flexible strain relief together to form an internal channel with different internal diameter for securely retaining said cable such that said two halves of said strain relief engage against opposite sides of said cable for relieving any strain transmitted on said cable; (h) whereby prior to snapping together said two halves of said connector shell, said connector is placed in said longitudinal slot at said front portion of said first half of said connector shell and said transverse plate of said connector is retained in said transverse slot of said front end of said first half of said connector shell, and said strain relief is placed in said longitudinal slot at said rear portion of said first half of said connector shell and said two lateral ribs of said strain relief is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said connector and said strain relief.

Further defined alternatively in detail, the present invention is a method of retaining a connector and a radio jack having a multiplicity of wires, the multiplicity of wires connected to the connector, the method comprising the steps of: (a) providing a connector shell having a first half and an identical second half, each half having a longitudinal slot with a front portion for housing said connector, and a rear portion for housing said radio jack, a transverse slot on a front end for receiving a transverse plate of said connector, a first and second transverse slots on an extended rear end for receiving a first and second notches of said radio jack, a first lateral side and a second lateral side; (b) interlocking said first and second halves of said connector shell together for receiving and partially enclosing said connector and said radio jack; (c) providing a first and a second unisex spring-loaded turn wheel mechanisms each having a spring, a reversible member and a base, the reversible member having a first end and a second end, the first end has a male screw post and the second end has a female screw nut, the base having a first end and a second end, the first end has an opening for accommodating said spring and the reversible member respectively, and the second end has a cross shaped slot for accommodating a driving tool; (d) changing said reversible members to said male screw posts or said female screw nuts by reversing said reversible members; and (e) retaining said first and second unisex spring-loaded turn wheel mechanisms to said first and second lateral sides of said connector shell; (f) whereby prior to snapping together said two halves of said connector shell, said connector is placed in said longitudinal slot at said front portion of said first half of said connector shell and said transverse plate of said connector is retained in said transverse slot of said front end of said first half of said connector shell, and said radio jack is placed in said longitudinal slot at said rear portion of said first half of said connector shell and said two notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retained said connector and said radio jack.

Further defined alternatively broadly, the present invention is a method of retaining a connector and an adapter having a multiplicity of wires, the multiplicity of wires connected to the connector, the method comprising the steps of: (a) providing a connector shell having two identical halves, each half having a longitudinal slot with a front portion for housing said connector, and a rear portion for housing said adapter, a transverse slot on a front end for receiving a transverse plate of said connector, two transverse slots on an extended rear end for receiving said adapter and two lateral sides; (b) interlocking said two identical halves of said connector shell together for receiving and partially enclosing said connector and said adapter; (c) providing two unisex spring-loaded turn wheel mechanisms each having a spring, a reversible member and a base, the reversible member having a male screw post at one end and a female screw nut at an opposite end, the base having an opening at one end for accommodating said spring and said reversible member respectively, and a cross shaped slot at an opposite end for accommodating a driving tool; (d) changing said reversible members to said male screw posts or said female screw nuts by reversing said reversible members; and (e) retaining said two unisex spring-loaded turn wheel mechanisms to said two lateral sides of said connector shell; (f) whereby prior to snapping together said two halves of said connector shell, said connector is placed in said longitudinal slots at said front portions of said connector shell and said transverse plate of said connector is retained in said transverse slots of said front ends of said connector shell, and said adapter is placed in said longitudinal slots at said rear portions of said connector shell and said adapter is retained in said two transverse slots of said extended rear end of said connector shell, said springs and said reversible members are placed in said bases respectively of said two unisex spring-loaded turn wheel mechanisms which show said male screw posts for adapting an opposite said female screw nuts, said connector shell is snapped together to retained said connector and said adapter.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A connector shell assembly for a 9-pin connector and a radio jack having a multiplicity of wires, the multiplicity of wires connected to the 9-pin connector, the connector shell assembly comprising:

a. an elongated rigid connector shell having a first half and an identical second half, each half having a longitudinal slot with a front portion for housing said 9-pin connector, and a rear portion for housing said radio jack, a transverse slot on a front end for receiving a transverse plate of said 9-pin connector, a first and a second transverse slots on an extended rear end for receiving a first and a second transverse notches of said radio jack, a first lateral side and a second lateral side;

b. means for interlocking said first and second halves of said connector shell together for receiving and partially enclosing said 9-pin connector and said radio jack;

c. a first and a second unisex spring-loaded turn wheel mechanisms each having a spring, a reversible member and a base;

d. said reversible member having a first end and a second end, the first end has a male screw post and the second end has a female screw nut;

e. said base of said first and second unisex spring-loaded turn wheel mechanisms having a first end and a second end, the first end has an opening for accommodating said spring and said reversible member respectively, and the second end has a cross shaped slot for accommodating a driving tool; and f. means for retaining said first and second unisex spring-loaded turn wheel mechanisms to said first and second lateral sides of said connector shell respectively;

g. whereby prior to snapping together said two halves of said connector shell, said 9-pin connector is placed in said longitudinal slot at said front portion of said first half of said connector shell and said transverse plate of said 9-pin connector is retained in said transverse slot of said front end of said first half of said connector shell, and said radio jack is placed in said longitudinal slot at said rear portion of said first half of said connector shell and said two transverse notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retain said 9-pin connector and said radio jack.

2. The invention as defined in claim 1 wherein said means for interlocking said first and second halves of said connector shell include two male fastener posts and two female fastener recesses located alternatively on each lateral side of said first and second halves of said connector shell, the two male fastener posts on one lateral side are off-set with the two female fastener recesses on the opposite lateral side, so that the male fastener posts and the female fastener recesses on said first half are complementary to those on said second half of said connector shell.

3. The invention as defined in claim 1 wherein said means for interlocking said first and second halves of said connector shell include one central male fastener post and one central female fastener recess located adjacent to said extended rear ends of said connector shell.

4. The invention as defined in claim 1 wherein said9-pin connector is a male 9-pin plug connector.

5. The invention as defined in claim 1 wherein said 9-pin connector is a female 9-pin socket connector.

6. The invention as defined in claim 1 wherein said means for retaining said first and second unisex spring-loaded turn wheel mechanisms include closed adapting members located at a location adjacent to said front end of said connector shell and partially open adapting members located at a location adjacent to a midsection of said connector shell, the adapting members are respectively integrally molded to said first and second lateral sides of said connector shell.

7. The invention as defined in claim 1 wherein said connector shell is manufactured in an injection molding process.

8. The invention as defined in claim 1 wherein said connector shell is made of plastic material.

9. The invention as defined in claim 1 wherein said first and second unisex spring-loaded turn wheel mechanisms are made of poly carbon material.

10. A connector shell assembly for a 25-pin connector and a radio jack having a multiplicity of wires, the multiplicity of wires connected to the 25-pin connector, the connector shell assembly comprising:

a. an elongated rigid connector shell having a first half and an identical second half, each half having a longitudinal slot with a front portion for housing said 25-pin connector, and a rear portion for housing said radio jack, a transverse slot on a front end for receiving a transverse plate of said 25-pin connector, a first and a second transverse slots on an extended rear end for receiving a first and a second transverse notches of said radio jack, a first lateral side and a second lateral side;

b. means for interlocking said first and second halves of said connector shell together for receiving and partially enclosing said 25-pin connector and said radio jack;

c. a first and a second unisex spring-loaded turn wheel mechanisms each having a spring, a reversible member and a base;

d. said reversible member having a first end and a second end, the first end has a male screw post and the second end has a female screw nut;

e. said base of said first and second unisex spring-loaded turn wheel mechanisms having a first end and a second end, the first end has an opening for accommodating said spring and said reversible member respectively, and the second end has a cross shaped slot for accommodating a driving tool; and f. means for retaining said first and second unisex spring-loaded turn wheel mechanisms to said first and second lateral sides of said connector shell respectively;

g. whereby prior to snapping together said two halves of said connector shell, said 25-pin connector is placed in said longitudinal slot at said front portion of said first half of said connector shell and said transverse plate of said 25-pin connector is retained in said transverse slot of said front end of said first half of said connector shell, and said radio jack is placed in said longitudinal slot at said rear portion of said first half of said connector shell and said two transverse notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connector shell is snapped together to retain said 25-pin connector and said radio jack.

11. The invention as defined in claim 10 wherein said means for interlocking said first and second halves of said connector shell include two male fastener posts and two female fastener recesses located alternatively on each lateral side of said first and second halves of said connector shell, the two male fastener posts on one lateral side are off-set with the two female fastener recesses on the opposite lateral side, so that the male fastener posts and the female fastener recesses on said first half are complementary to those on said second half of said connector shell.

12. The invention as defined in claim 10 wherein said means for interlocking said first and second halves of said connector shell include one central male fastener post and one central female fastener recess located adjacent to said extended rear ends of said connector shell.

13. The invention as defined in claim 10 wherein said 25-pin connector is a male 25-pin plug connector.

14. The invention as defined in claim 10 wherein said 25-pin connector is a female 25-pin socket connector.

15. The invention as defined in claim 10 wherein said means for retaining said first and second unisex spring-loaded turn wheel mechanisms are closed adapting members located at a location adjacent to said front end of said connector shell and partially open adapting members located at a location adjacent to a midsection of said connector shell, the adapting members are respectively integrally molded to said first and second lateral sides of said connector shell.

16. The invention as defined in claim 10 wherein said connector shell is manufactured in an injection molding process.

17. The invention as defined in claim 10 wherein said connector shell is made of plastic material.

18. The invention as defined in claim 10 wherein said first and second unisex spring-loaded turn wheel mechanisms are made of poly carbon material.

19. A method of retaining a connector and a radio jack having a multiplicity of wires, the multiplicity of wires connected to the connector, the method comprising the steps of:

a. providing a connector shell having a first half and an identical second half, each half having a longitudinal slot with a front portion for housing said connector, and a rear portion for housing said radio jack, a transverse slot on a front end for receiving a transverse plate of said connector, a first and second transverse slots on an extended rear end for receiving a first and second notches of said radio jack, a first lateral side and a second lateral side;

b. interlocking said first and second halves of said connector shell together for receiving and partially enclosing said connector and said radio jack;

c. providing a first and a second unisex spring-loaded turn wheel mechanisms each having a spring, a reversible member and a base, the reversible member having a first end and a second end, the first end has a male screw post and the second end has a female screw nut, the base having a first end and a second end, the first end has an opening for accommodating said spring and the reversible member respectively, and the second end has a cross shaped slot for accommodating a driving tool;

d. changing said reversible members to said male screw posts or said female screw nuts by reversing said reversible members; and e. retaining said first and second unisex spring-loaded turn wheel mechanisms to said first and second lateral sides of said connector shell;

f. whereby prior to snapping together said two halves of said connector shell, said connector is placed in said longitudinal slot at said front portion of said first half of said connector shell and said transverse plate of said connector is retained in said transverse slot of said front end of said first half of said connector shell, and said radio jack is placed in said longitudinal slot at said rear portion of said first half of said connector shell and said two notches of said radio jack is retained in said two transverse slots of said extended rear end of said first half of said connector shell, said springs and said reversible members are placed in said bases respectively of said unisex spring-loaded turn wheel mechanisms which show said male screw posts for adapting an opposite said female screw nuts, said connected shell is snapped together to retain said connector and said radio jack.

20. A connector shell assembly for a connector and a radio jack having a multiplicity of wires, the multiplicity of wires connected to the connector, the connector shell assembly comprising:

a. a connector shell having two identical halves, each half having a longitudinal slot with a front portion for housing said connector, and a rear portion for housing said radio jack, a transverse slot on a front end for receiving a transverse plate of said connector, two transverse slots on an extended rear end for receiving said radio jack and two lateral sides;

b. means for interlocking said two identical halves of said connector shell together for receiving and partially enclosing said connector and said radio jack;

c. two unisex spring-loaded turn wheel mechanisms each having a spring, a reversible member and a base;

d. said reversible member having a male screw post at one end and a female screw nut at an opposite end;

e. said base having an opening at one end for accommodating said spring and said reversible member respectively, and a cross shaped slot at an opposite end for accommodating a driving tool; and f. means for retaining said two unisex spring-loaded turn wheel mechanisms to said two lateral sides of said connector shell;

g. whereby prior to snapping together said two halves of said connector shell, said connector is placed in said longitudinal slots at said front portions of said connector shell and said transverse plate of said connector is retained in said transverse slots of said front ends of said connector shell, and said radio jack is placed in said longitudinal slots at said rear portions of said connector shell and said radio jack is retained in said two transverse slots of said extended rear end of said connector shell, said springs and said reversible members are placed in said bases respectively of said two unisex spring-loaded turn wheel mechanisms which show said male screw posts for adapting an opposite said female screw nuts, said connector shell is snapped together to retain said connector and said radio jack.

21. The invention as defined in claim 20 wherein said means for interlocking said two identical halves of said connector shell include two male fastener posts and two female fastener recesses, the two male fastener posts on one lateral side are off-set with the two female fastener recesses on the opposite lateral side.

22. The invention as defined in claim 20 wherein said means for interlocking said two identical halves of said connector shell include one central male fastener post and one central female fastener recess.

23. The invention as defined in claim 20 wherein said connector is a male 9-pin plug connector.

24. The invention as defined in claim 20 wherein said connector is a female 9-pin socket connector.

25. The invention as defined in claim 20 wherein said connector is a male 25-pin plug connector.

26. The invention as defined in claim 20 wherein said connector is a female 25-pin socket connector.

27. The invention as defined in claim 20 wherein said means for retaining said two unisex spring-loaded turn wheel mechanisms include closed adapting members and partially open adapting members, the adapting members are respectively integrally molded to said two lateral sides of said connector shell.

28. The invention as defined in claim 20 wherein said connector shell and said radio jack are manufactured in an injection molding process.

29. The invention as defined in claim 20 wherein said connector shell is made of plastic material.

30. The invention as defined in claim 20 wherein said two unisex spring-loaded turn wheel mechanisms are made of poly carbon material.

* * * * *